US007232078B2

(12) United States Patent
Kah, Jr.

(10) Patent No.: US 7,232,078 B2
(45) Date of Patent: Jun. 19, 2007

(54) SPEED LIMITING FOR ROTARY DRIVEN SPRINKLER

(76) Inventor: Carl L Kah, Jr., 1157 Turtle Beach Rd., Lost Tree, North Palm Beach, FL (US) 33408

( * ) Notice: Subject to any disclaimer, the term of this patent is extended or adjusted under 35 U.S.C. 154(b) by 252 days.

(21) Appl. No.: 10/774,182

(22) Filed: Feb. 6, 2004

(65) Prior Publication Data

US 2004/0164178 A1 Aug. 26, 2004

Related U.S. Application Data

(60) Provisional application No. 60/446,171, filed on Feb. 7, 2003.

(51) Int. Cl.
*B05B 17/00* (2006.01)

(52) U.S. Cl. ..... 239/1; 239/263.3; 239/263.2; 239/256; 239/237; 239/233; 239/204; 239/205; 239/206

(58) Field of Classification Search ..... 239/201, 239/203, 204, 205, 206, 210, 231, 233, 237, 239/240, 251, 252, 256, 263
See application file for complete search history.

(56) References Cited

U.S. PATENT DOCUMENTS

| | | | | |
|---|---|---|---|---|
| 3,107,056 | A | 10/1963 | Hunter | |
| 4,568,024 | A | 2/1986 | Hunter | |
| 4,624,412 | A | 11/1986 | Hunter | |
| 4,634,052 | A * | 1/1987 | Grizzle et al. | 239/205 |
| 4,718,605 | A | 1/1988 | Hunter | |
| 4,796,809 | A | 1/1989 | Hunter | |
| 4,815,662 | A | 3/1989 | Hunter | |
| 4,867,379 | A | 9/1989 | Hunter | |
| 4,932,590 | A * | 6/1990 | Hunter | 239/222.17 |
| 4,948,052 | A | 8/1990 | Hunter | |
| 4,971,250 | A * | 11/1990 | Hunter | 239/222.17 |
| 5,058,806 | A | 10/1991 | Rupar | |
| 5,086,977 | A | 2/1992 | Kah, Jr. | |
| 5,288,022 | A | 2/1994 | Sesser | |
| 5,372,307 | A | 12/1994 | Sesser | |
| 5,375,768 | A | 12/1994 | Clark | |
| 5,377,914 | A | 1/1995 | Christen | |
| RE35,037 | E | 9/1995 | Kah, Jr. | |
| 5,762,270 | A | 6/1998 | Kearby et al. | |
| 5,823,439 | A * | 10/1998 | Hunter et al. | 239/205 |
| 5,823,440 | A | 10/1998 | Clark | |
| 5,927,607 | A | 7/1999 | Scott | |
| 5,971,297 | A | 10/1999 | Sesser | |
| 6,199,584 | B1 | 3/2001 | Brown et al. | |
| 6,732,950 | B2 | 5/2004 | Ingham, Jr. et al. | |
| 2002/0162901 | A1 | 11/2002 | Hunter | |

* cited by examiner

*Primary Examiner*—Dinh Q. Nguyen
(74) *Attorney, Agent, or Firm*—Ostrolenk, Faber, Gerb & Soffen, LLP

(57) ABSTRACT

A speed limiting mechanisms for turbine-driven fluid distribution apparatus usable with compressible fluid such as compressed air and incompressible fluid such as water. Dynamic viscous damping of the turbine output power train is used to control the rotational speed of the turbine. This prevents overspeeding when the turbine is air driven, and also when the turbine is water driven, under abnormal conditions such as blockage of a bypass area designed to control the turbine speed by limiting flow to the turbine. The same mechanism can be used to impose a lower rotational speed in the turbine during normal operation in conjunction with a turbine optimized for lower speed operation to reduce the required gear reduction in the power train.

69 Claims, 5 Drawing Sheets

SPEED LIMITING FOR ROTARY DRIVEN SPRINKLER

CROSS-REFERENCE TO RELATED APPLICATIONS

This application is based on and claims priority to U.S. Provisional Application 60/446,171, filed Feb. 7, 2003, the entire disclosure of which is incorporated herein by reference.

This application is also related to my U.S. patent application Ser. No. 10/141,261, filed May 7, 2002, entitled SPEED LIMITING TURBINE FOR ROTARY DRIVEN SPRINKLER, the entire disclosure of which is also incorporated herein by reference.

BACKGROUND OF THE INVENTION

1. Technical Field of the Invention

The present invention relates to speed limiting for a water turbine or other water motor driven sprinklers, and more particularly, to a method and apparatus which employs dynamic viscous braking to control the water motor output shaft speed in an improved, convenient and reliable manner. By employment of the invention, a sprinkler system can be winterized by purging water from the system using high pressure air, without the risk of damage to the rotating parts due to overspeeding, while also preventing overspeeding due to other causes such as a clogged pressure relief bypass mechanism. In addition, the invention can be employed to limit the maximum rotational speed of the water motor, thereby simplifiying the design and construction of the transmission used to couple the water motor to the rotating nozzle.

For simplicity, the invention will be described in the context of a gear driven sprinkler powered by a water driven turbine, but it is to be understood that the invention is also applicable to and comprehends within its scope, reversing sprinklers and/or sprinklers having other types of water driven motors to rotate a distribution nozzle.

2. Relevant Art

As explained in above-referenced U.S. patent application Ser. No. 10/141,261, sprinkler systems in northern climates must be drained or blown-out with air to prevent damage due to freezing. In systems powered by water driven turbines or the like, excessively high turbine shaft velocities can result when run with compressed air, because it is both relatively light compared to water, and expands across the turbine stator onto the turbine blades, in contrast with water, which is incompressible. Typical turbine driven sprinklers run 10-15 times faster when powered by compressed air (30-50 psi) than in normal operation with water.

High turbine shaft velocities can heat the shaft and cause it to seize to the plastic housing material. This prevents the turbine from turning and renders it unusable in the future unless care is taken to limit the system air, blow-out time and pressures. This has proved to be one of the major causes for premature failure of gear driven sprinkler in colder climates, where sprinklers are used for only part of the year, and should last much longer than in warmer climates where they are run year round.

Devices are known for controlling the rotational speed of turbine-driven sprinklers. One such device, shown in Clark U.S. Pat. No. 5,375,768, is designed to maintain constant turbine speed despite variations of inlet water pressure. The patented sprinkler relies on a throttling device to direct part of the water to the turbine rotor, and a pressure responsive valve to divert some of the water around the turbine. This design, however, and other known designs can not effectively limit rotational speed when the turbine is driven by a compressible fluid such as air, and still allow the turbine to run at a sufficiently high speed when it is driven by an incompressible fluid such as water because of the rapid expansion of the compressed air as it enters the turbine chamber, so far as applicant is aware.

The invention disclosed in above-referenced U.S. patent application Ser. No. 10/141,261 addresses the problems of overspeeding during winterization by providing a construction in which the turbine flow discharge area is substantially the same as or only slightly larger than the inlet stator area. In an alternative construction, the inlet stator flow area is separated from the turbine blades by a flow bleed area to bleed off a significant portion of the expanding air flow, i.e., the flow normally directed onto the turbine during water driven operation and in standard configuration sprinklers, before a portion of the air is deflected to strike the turbine blades to produce the turbine rotation.

In the above-described designs, water, being incompressible, does not experience expansion after flow through the stator inlet flow area and does not flow out the intermediate bleed but continues in its line of flow to be directed onto the turbine blades to run the turbine in a normal manner. In the case of air (compressible flow) the portion remaining after the intermediate bleed can be limited to just enough to turn the turbine at its normal speed as when water-driven.

Another known speed related issue in sprinkler systems concerns bypass mechanisms such as shown in the above-mentioned Clarke patent which are intended to maintain constant turbine shaft speed independent of inlet water pressure variations. If these devices become obstructed or otherwise malfunction, undesirable speed variations, and in extreme cases, damage to the rotating parts can occur.

Yet a further known speed related issue involves design of the power train which couples the turbine to the sprinkler head. Sprinkler systems often include sprinklers having nozzles with different flow rates and water travel distances to accommodate the shape and size of the area being irrigated. The turbines must therefore be designed for efficient momentum transfer from the flowing water to assure adequate torque for driving the sprinkler head under all operating conditions. For this reason, the turbines typically rotate at speeds in the range of about 1,000 to 2,000 RPM or higher. The rotational speed of the nozzle, however, is typically in the range of about 1-2 RPM, for short or medium range sprinklers, or even less for long range sprinklers, as the circumferential speed of the water stream limits the effective range. To achieve such low speeds, larger gear reduction is needed than required to past provide the necessary driving torque for rotating nozzle drive shaft which may be ⅜ to 1 inch diameter to conduct the water to the propagation nozzle which is being rotated. If the turbine could conveniently be made to run slower, the gear reduction mechanism could be simplified less part and further reduced in size. This could be an important incentive for promoting more widespread use of gear driven sprinklers which provide more uniform coverage and lower water use than the spray heads now used in a majority of the irrigations system sprinklers.

A need clearly exists for an approach to speed control which addresses all of these problems in an integrated manner.

SUMMARY OF THE INVENTION

The present invention meets the above-described need by applying dynamic viscous braking to the power train which couples the turbine output shaft to the sprinkler head. This can provide turbine speed limiting when the sprinkler is air-driven, with little or no speed limiting during normal water driven operation. Speed limiting is also provided if the sprinkler overspeeds due to a blocked by-pass flow valve, or other malfunction.

At the same time, because the speed limiting effect is exponentially dependent on the rotational speed of the turbine, the invention can be used in conjunction with proper turbine design to provide a governor which limits the turbine speed even when it is water driven in normal operation. As a consequence, in addition to providing overspeeding protection, the turbine can be designed to extract the needed power for stable operation at a lower speed. As a consequence, less speed reduction is needed in the gear box to achieve a low nozzle rotational speed (for longer range of coverage around the sprinkler) while still providing good driving torque (for a substantially constant precipitation rate over a wide range of nozzle flow outputs).

According to a first aspect of the invention, speed control is provided by a dynamic viscous damping mechanism including a damping member coupled to the turbine output shaft which rotates in a closed chamber containing a small quantity of a viscous damping medium or fluid. The damping mechanism can be located at any desired or convenient location along the power train from the turbine rotor output shaft to the nozzle drive shaft, but the turbine shaft area requires the minimum amount of braking torque for speed control and thus smallest amount of viscous medium.

The maximum rotational speed is determined by optimizing the design of the damping mechanism and selection of the fluid viscosity to obtain a desired rate of shear of the viscous fluid in the confined space surrounding the damping member for the most severe turbine inlet conditions anticipated. Since the damping effect is speed related, the turbine speed is limited by the substantially increased torque required to increase speed over the drag provided by the dynamic viscosity of the damping fluid.

According to a second aspect of the invention, in a preferred embodiment, a bearing for the turbine output shaft is comprised of opposed shaft seals at the ends of a tubular damping chamber which provides a hollow cavity surrounding the shaft. The cavity contains a quantity of viscous fluid. In one variant, the turbine shaft can include ribs longitudinally extending in the cavity area to increase the fluid shear interaction. In another variant, a larger diameter member can be mounted on the shaft in the cavity area to increase the shear area between the fluid rotating shaft and the stationary cavity housing. The fluid viscosity is selected to allow a desired fluid shear speed with and acceptable torque loss. If available torque tends to increase the turbine rotational speed excessively, the shear forces of the fluid limit the turbine speed.

In a third variant, the gear box itself can serve as the damping chamber, but that will generally require larger quantities of fluid and be harder to seal reliably for years of in ground operation.

As shown for example in U.S. Pat. No. 5,086,977, issued Feb. 11, 1992 for Sprinkler Device, in the past, sprinkler gear boxes were sometimes filled with a low-viscosity lubricant to protect rotating metal parts from exposure to water-borne contaminants such as dissolved calcium salts which could dry and harden on the parts. The viscosity of the lubricant might have produced some incidental damping, but not enough to prevent overspeeding during air driven operation or to establish a maximum rotation speed for the turbine, so far as applicant is aware. Moreover, it has been found that because of the difficulty in providing a reliable seal, and for this and other reasons, water lubricated gear boxes are now customarily used.

According to a third aspect of the invention, by proper design of the water driven turbine and the dynamic viscous breaking mechanism, a desired normal rotation speed can be established for the turbine which is lower than that customarily employed. This allows obtaining the desired rotation speed and driving torque for the sprinkler head using a lower gear ratio in the gear train, while still providing sufficient low speed torque for reliable operation, whereby the components and the entire device can be simpler, smaller and less expensive to manufacture.

According to a fourth aspect of the invention, there is provided a method of speed control for a water turbine driven sprinkler in which an incoming water stream is directed through the water turbine, the turbine is coupled through a power train including an output shaft, a transmission, and a nozzle drive shaft to drive a sprinkler head including a nozzle, and dynamic viscous braking is applied to the power train to establish a normal angular speed for the sprinkler head. According to this method, the braking applied, and the power delivery characteristics of the turbine are selected to obtain a desired water delivery range and precipitation rate for the nozzle at the established angular speed.

Further according to the fourth aspect of the invention, the nozzle may be removable to substitute another nozzle having a different flow rate, or adjustable to provide a selectable flow rate, and the turbine is designed to provide sufficient torque for reliably driving the sprinkler to provide a substantially constant precipitation rate with any of the available nozzles or selected flow rates.

Still further according to the fourth aspect of the invention, the applied dynamic viscous braking results in speed limiting solely as a function of the rotational speed, irrespective of whether the turbine is water driven for normal operation, or air driven for winterization.

It is accordingly an object of this invention to provide an improved rotary sprinkler for an irrigation system having a speed control mechanism which prevents overspeeding when the turbine is air-driven to purge the system of water for winterizing, or when other abnormal conditions exist which could cause overspeeding.

It is a further object of the invention to provide a speed limiting mechanism which can be used to regulate the speed of a water turbine driven sprinkler under normal operating conditions so the amount of speed reduction provided by the gear train can be reduced, thereby simplifying the mechanism, and reducing its size and cost.

Other objects, features and advantages of the present invention will become apparent from the following description of the invention which refers to the accompanying drawings.

BRIEF DESCRIPTION OF THE DRAWINGS

Like parts bear the same reference numerals in each of the figures.

DETAILED DESCRIPTION OF THE INVENTION

Figure 1:
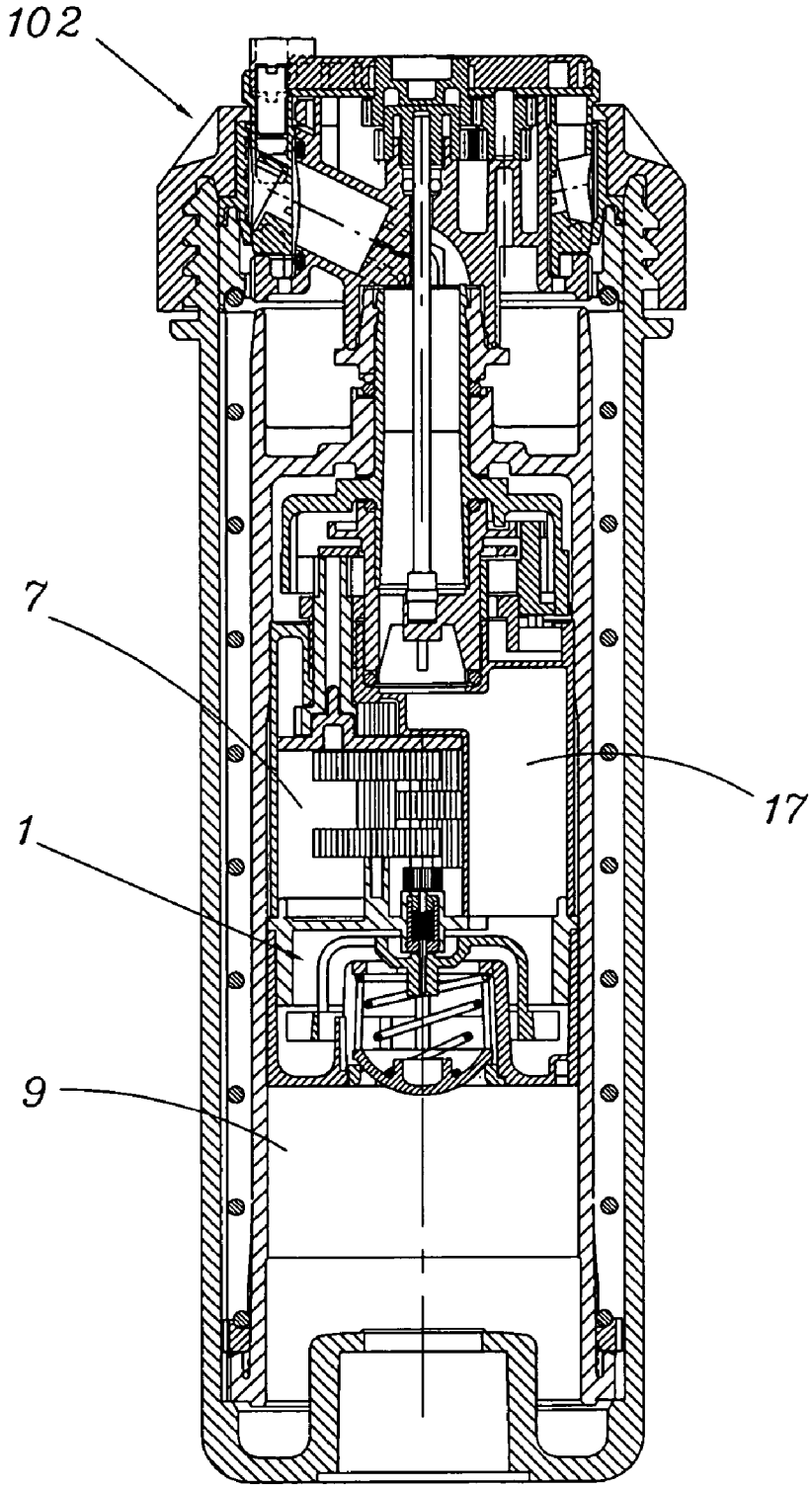
FIG. 1 shows a cross section of a typical gear driven sprinkler.

FIG. 1 shows in cross section, generally denoted at 100, a water turbine driven sprinkler such as described in detail in my U.S. Pat. Re. 35,037, the entire disclosure of which is incorporated herein by reference as if fully set forth.

Figure 2:
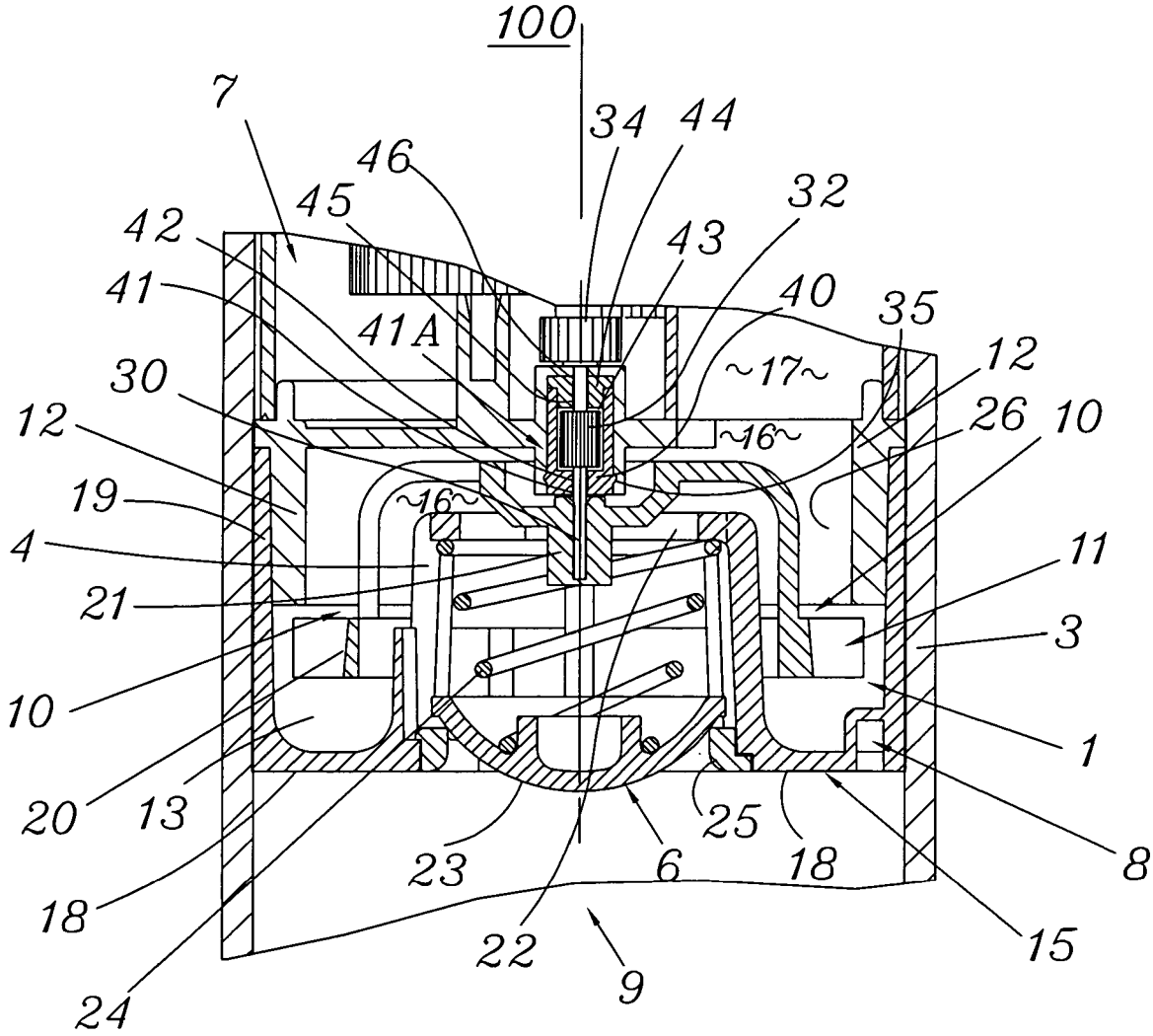
FIG. 2 shows a partial cross sectional view of a gear driven sprinkler such as that of FIG. 1 having a speed limiting viscous turbine bearing according to a first embodiment of the invention.
Figure 3:
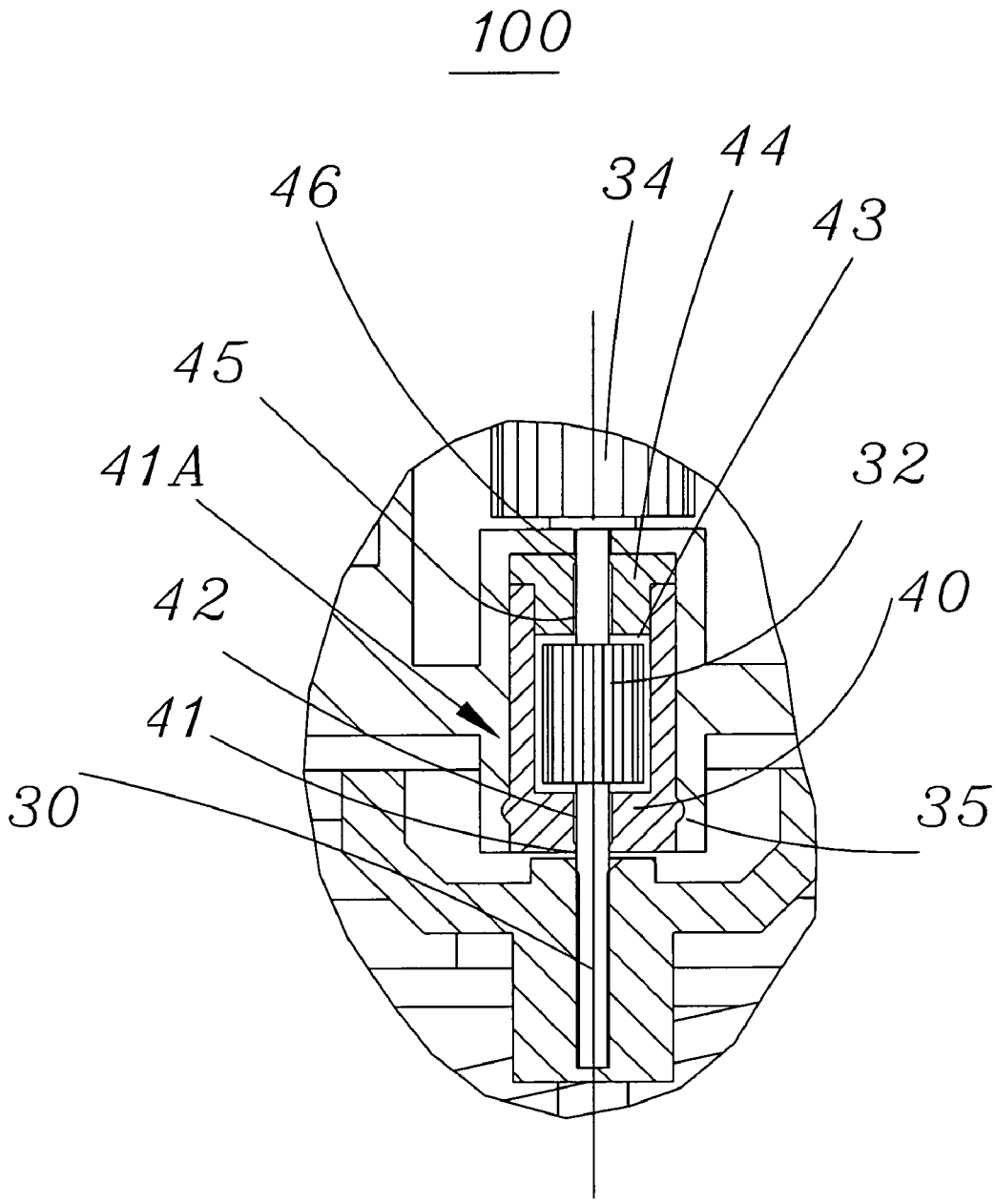
FIG. 3 shows an enlarged view of the bearing area of FIG. 2.

FIGS. 2 and 3 illustrate a turbine assembly, generally denoted at 1, for sprinkler 100 which incorporates a first embodiment of the invention. Referring to FIGS. 1-3, turbine assembly 1 is mounted in a housing 3, and, by way of an output shaft 30 and a gear 34, drives a gearbox 7, which rotates or oscillates a sprinkler head 102 in any conventional or desired manner. As will be understood, water (or during winterization, compressed air) entering turbine assembly 1 from below at 9 drives the turbine, and thereafter flows through an outlet passage 17 to the sprinkler head.

The turbine itself is comprised of a rotor 11 located in a rotor chamber 13 formed by a stator cover assembly 15 positioned on the upstream side of the turbine, and by a lower cover 12 for gearbox 7. Stator cover assembly 15 is in the form of an inverted cup with a central portion 4 that houses a flow bypass valve subassembly 6 described below.

Extending radially from the bottom of central portion 4 is a shoulder 18 which terminates in an upwardly extending skirt portion 19. Circumferentially spaced around the bottom shoulder 18 are a plurality of tangentially directed turbine stator flow inlet ports 8 through which water flows into rotor chamber 13. As the incoming fluid passes through openings 8, it experiences acceleration due to differential pressure, and then tangentially strikes the turbine rotor 11, causing it to turn, and to drive gearbox 7 though shaft 30.

The fluid then exits rotor chamber 13 through an annular discharge port 10 between the turbine rotor 11 and a circumferential blade support ring 20 and the lower gear box cover ring 12. Discharge port 10 communicates with an outer chamber 16 above stator cover 15, which, in turn, communicates with discharge passage 17.

The hub portion 21 of rotor 11 passes through a circular opening 22 at the top of stator 15. Circular opening 22 also provides communication between the interior of stator cup 4 and outer chamber 16.

Turbine by-pass valve assembly 6, which is located within stator cup 4 is comprised of a valve plug 23 which is biased into a closed position against the upper surface of a valve seat member 25 by a spring 24. As will be understood, when the inlet fluid pressure is sufficient to overcome the force of spring 24, a portion of incoming fluid is diverted by valve 6 to discharge passage 17 through the interior of stator cup 4, circular opening 22, and outer chamber 16. The purpose of this valve is to maintain the desired differential pressure across the turbine inlet ports 8, thereby driving the turbine at the desired speed and power with water.

Achieving proper performance for the sprinkler both when the turbine is water-driven and also preventing over speeding when it is air-driven depends on the selection of the area of turbine circumferential discharge port 10 and the flow pressure drop established by flow control valve 6.

Bypass flow valve 6 opens to allow flow in excess of what is needed to drive the turbine to be bypassed around the turbine rotor, thus establishing the required differential pressure across opening 8 to provide the desired turbine speed and power by the strength of spring 24 acting on valve member 23.

The turbine rotor speed is a result of momentum interchange between the flow and the turbine blading and depends on turbine design. The construction illustrated is a simple and efficient configuration for obtaining the power the turbine must provide to rotate the sprinkler head. Other designs may also be successfully employed within the scope of this invention.

To prolong the life of sprinkler 100, the turbine shaft bearing 42 is preferably formed of a material such as tire type rubber or the like which exhibits high abrasion resistance and melting temperature. Further, to avoid premature failure due to overspeeding of the turbine while it is being driven by compressed air during winterizing, or due to other abnormal conditions, speed limiting dynamic viscous braking is also employed.

Dynamic viscous braking is achieved according to this embodiment of the invention, by the unique design of turbine shaft bearing 42. The latter is comprised of a lower portion 40 having a seal lip area 41 which surrounds the lower end of rotor output shaft 30, a central body portion 41A, and an upper portion 44 which includes a seal lip area 46 and bearing area 45 to support rotor output shaft member 30. Upper portion is designed to be plugged into lower rubber bearing area 40, and is retained therein by a detent 35 to define a fluid cavity 43, within which is placed a quantity of viscous fluid, as described more fully below.

The damping effect is determined both by the viscosity of the fluid, and the configuration of a damping member 32 which may be integral with the portion of rotor output shaft 30 located in cavity 43. In the embodiment of FIGS. 2 and 3, damping member 32 is formed by molded or stamped ribs or serrations extending longitudinally and radially on shaft 30. Alternatively, damping member 32 could be separately formed, and mounted on shaft 30. The ribs are dimensioned and configured to occupy most of the volume of cavity 43 with the clearance to the inner wall of cavity 43 in the range of about 0.005 to about 0.015 inches, depending on the viscosity of the damping fluid.

The viscous fluid may be of any composition which is compatible with the materials forming bearing 42. Such fluids include silicone fluids such as polydimethyl siloxane polymers sold under the name 200 Fluid® obtainable from Dow Coming Corporation of Midland Mich., or any equivalent. With 200 Fluid® having a viscosity of 500 centistokes, a standard gear driven sprinkler such as the Model K1 manufactured by K-Rain Manufacturing Corp. of Riviera Beach, Fla. using this oil to provide viscous speed damping in the gear box, exhibits about a 6-fold speed reduction when driven by high pressure (30-50 psi) air compared with an unmodified sprinkler which, in turn, exhibits a 10-15 fold speed increase when run on 30-50 psi compressed air. When run on water, the modified K1 sprinkler exhibits substantially no difference in speed compared to the standard sprinkler. Other fluids such as SAE 10-70 weight oils or silicone oils of various viscosities can also yield satisfactory results.

Figure 4:
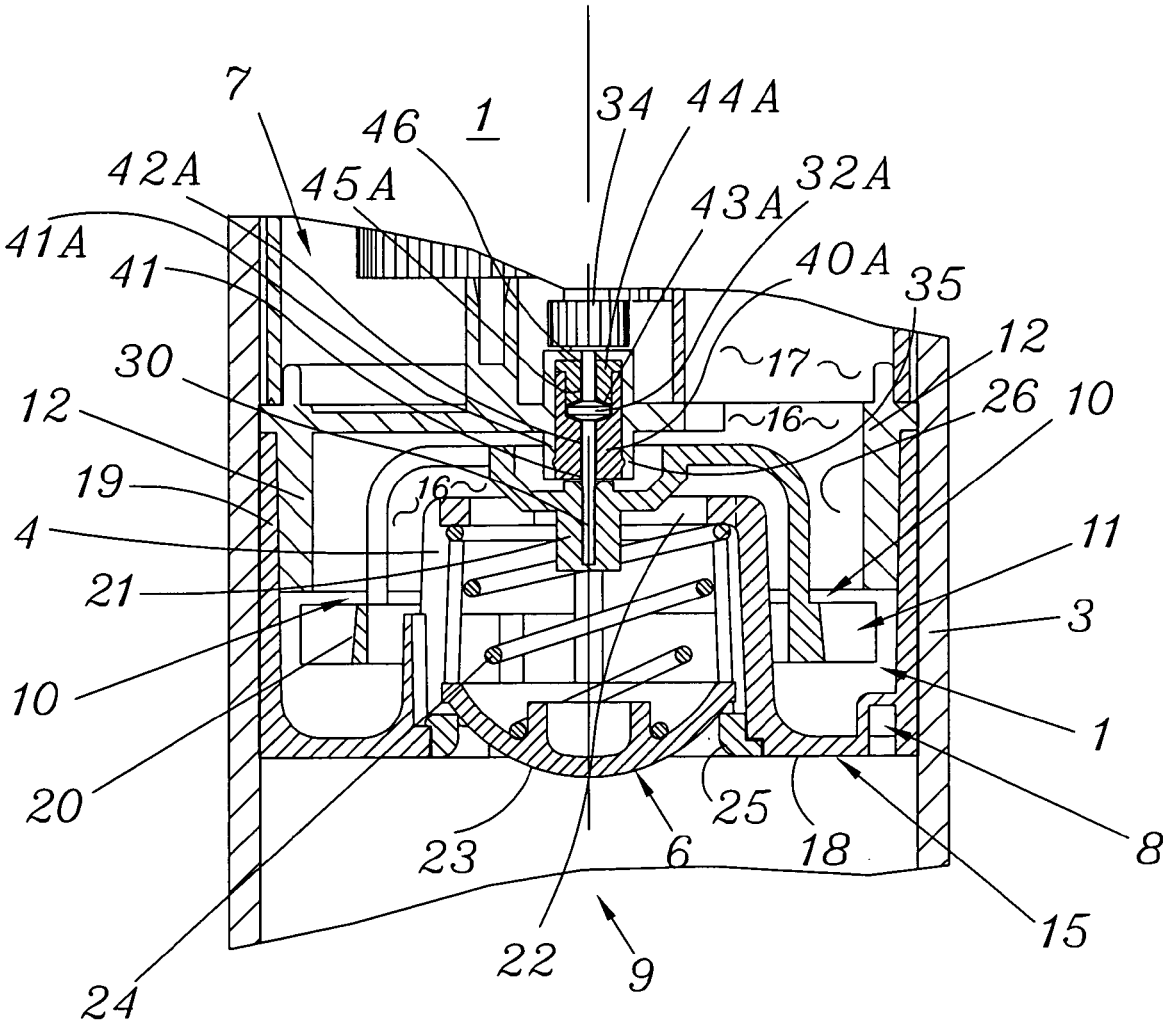
FIG. 4 shows a partial cross sectional view of a speed limiting viscous turbine bearing according to a second embodiment of the invention.
Figure 5:
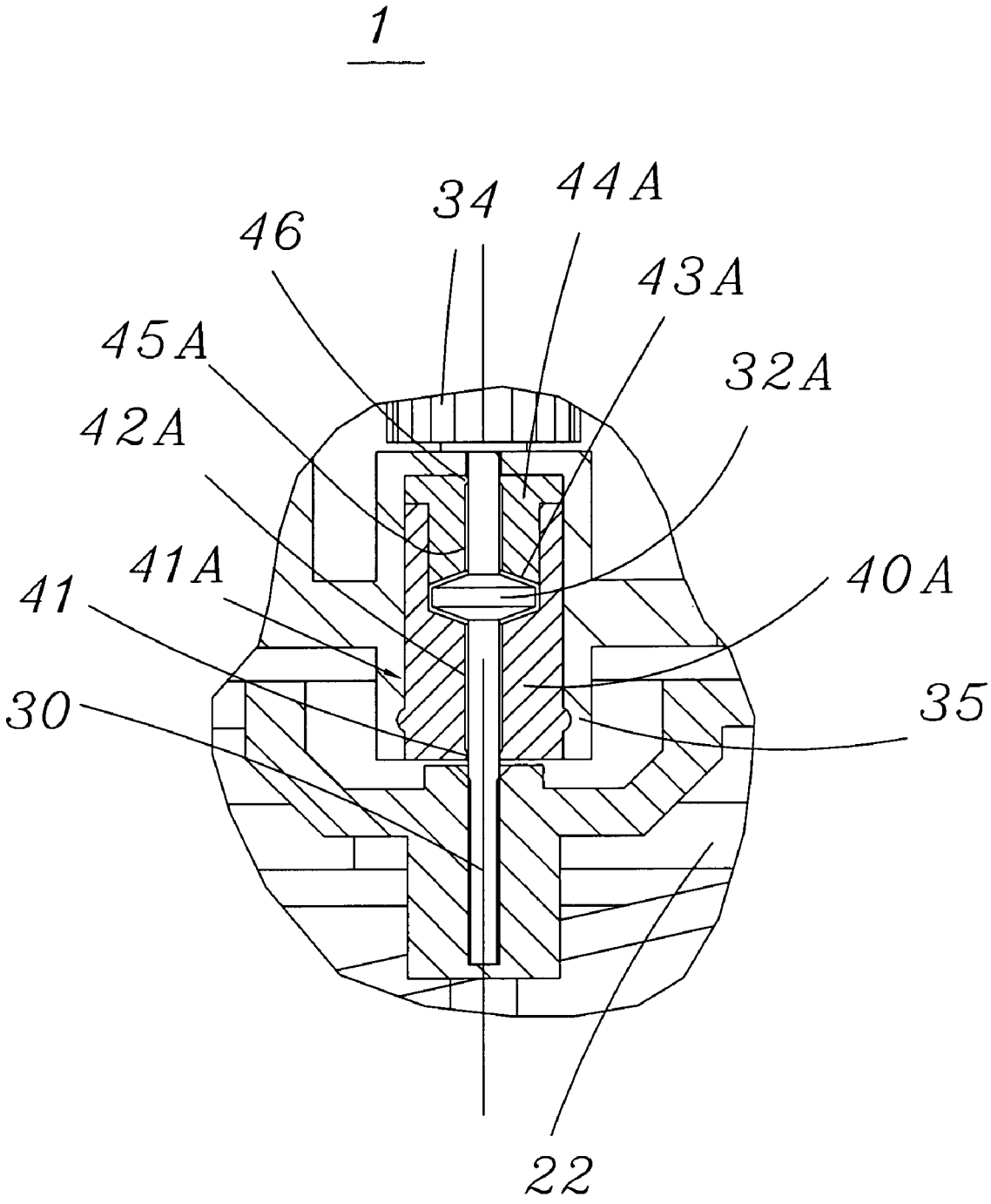
FIG. 5 shows an enlarged view of the bearing area of FIG. 4.

FIGS. 4 and 5 illustrate an alternative embodiment of the invention. This is substantially identical to the embodiment of FIGS. 2 and 3 except that the damping member on turbine output shaft 30 located in cavity 43A is in the form of a disc 32A having a diameter which is sized to be compatible with existing standard designs. Generally, however, it is found that a greater degree of high speed damping is achieved as the diameter of disc 32 is increased relative to the inside diameter of cavity 43A. The same composition and quantity of viscous fluid used in the embodiment of FIGS. 2 and 3 may be used in the embodiment of FIGS. 4 and 5.

The design of FIGS. 4 and 5 is desirable because the rotation of the closely fitting disc 32A increases the effect of molecular sheer and allows centrifugal force and disc surface face pumping to enhance drag with increasing speed to increased sheer load on the turbine shaft and resist over speed. In standard K-Rain gear driven sprinklers modified according to FIGS. 4 and 5, speed reductions of up to a factor of about 10 can be achieved compared to standard unmodified designs.

As those skilled in the art are aware, the partial differential equations which characterize fluid dynamics are quite complex, and yield exact solutions in only limited cases. Thus, practical application of the principles of this invention to particular products can best be achieved by modification and testing of existing devices with different damping mechanisms, and different quantities and viscosities of damping fluids. Implementation of such procedures will be within the capability of those skilled in the art.

As previously noted, conventional sprinkler turbines are designed to turn at 1,000 to 2,000 RPM. Other things being equal, reducing the turbine speed can cause inefficient momentum transfer to the turbine rotor and reduction in low speed torque due to turbulence and cavitation at the turbine. Accordingly, if it is desired to apply the principles of this invention to reduce the normal running speed of the turbine, as well as to provide overspeeding protection, the design of the turbine may be modified to direct a greater proportion of the incoming water flow through inlet ports 8 to the turbine through larger inlet ports to ensure the necessary torque available for turning the nozzle yet limit the nozzle drive shaft speed by speed viscous damping the turbine, there can thus be a lessor number of gears and smaller configuration sprinklers Other turbine designs will require comparable modifications, as will be understood by those skilled in the art.

As will also be appreciated, after a desired turbine operating speed has been obtained by selection of the geometry of the components of the damping mechanism, and selection of the quantity and viscosity of the damping fluid, and the turbine has been optimized for lower speed operation, corresponding changes can be made in the gearing to accommodate the decreased turbine speed.

For repeatable results at low cost, the parts are preferably formed by injection molding. Other techniques which yield repeatable results in an economic manner may also be employed.

Although the present invention has been described in relation to particular embodiments thereof, many other variations and modifications and other uses will be apparent to those skilled in the art. It is intended, therefore, that the present invention not be limited by the specific disclosures herein, but is to be given the full scope permitted by the appended claims.

What is claimed is:

1. A gear driven sprinkler comprising:

a fluid inlet connectable to a source of water;

a rotatable nozzle head having a water discharge nozzle;

a fluid powered motor which is driven by the incoming water;

a drive train rotationally coupled to the motor by a motor output shaft and coupled to provide power for rotating the nozzle head; and a dynamic viscous damping mechanism which cooperates with the drive train to limit the rotational speed of the fluid powered motor, wherein:

the viscous damping mechanism comprises:

a housing including a cavity which surrounds a portion of the drive train;

a viscous medium contained in the cavity; and the drive train includes a damping member located in the cavity on the motor output shaft which interacts with the viscous medium to generate a retarding torque that increases with the speed of the motor output shaft.

2. A sprinkler as defined in claim 1, wherein:

the motor output shaft extends through the cavity; and the damping member comprises an enlarged portion which extends longitudinally and radially relative to the motor output shaft in the cavity.

3. A sprinkler as defined in claim 2, wherein:

the fluid inlet is connectable to a source of compressed air when it is desired to purge water from the sprinkler; and the enlarged portion is sized in relation to the viscosity of the medium to provide sufficient braking when the motor is being driven by compressed air to prevent damage due to overspeeding.

4. A sprinkler as defined in claim 2, wherein the clearance between the enlarged portion and the inner wall of the cavity is in the range of about 0.005 to about 0.015 inch.

5. A sprinkler as defined in claim 2, wherein the viscosity of the viscous medium is between about SAE 10 and about SAE 70.

6. A sprinkler as defined in claim 2, wherein the viscous medium has a viscosity of about 500 centistokes.

7. A sprinkler as defined in claim 1, wherein the viscous medium is a silicone fluid.

8. A sprinkler as defined in claim 1, wherein:

the motor output shaft extends through the cavity; and the damping member comprises a disc mounted on the shaft within the cavity.

9. A sprinkler as defined in claim 8, wherein:

the fluid inlet is connectable to a source of compressed air when it is desired to purge water from the sprinkler; and the disc is sized in relation to the viscosity of the medium to provide sufficient braking when the motor is being driven by compressed air to prevent damage due to overspeeding.

10. A sprinkler as defined in claim 1, wherein the housing encloses a gear box in the drive train.

11. A sprinkler as defined in claim 1, wherein:

the fluid inlet is connectable to a source of compressed air when it is desired to purge water from the sprinkler; and the damping member is sized in relation to the viscosity of the medium to provide sufficient braking when the motor is being driven by compressed air to prevent damage due to overspeeding.

12. A sprinkler as defined in claim 1, wherein:

the fluid inlet is connectable to a source of compressed air when it is desired to purge water from the sprinkler; and the damping mechanism is sized and configured to provide sufficient braking when the motor is being driven by compressed air to prevent damage due to overspeeding.

13. A sprinkler as defined in claim 1, wherein the viscous damping mechanism comprises:

a bearing structure which supports the motor output shaft;

a cavity within the bearing structure which surrounds the motor output shaft;

liquid-tight seals at opposite ends of the cavity through which the motor shaft passes and which provide support for the motor output shaft;

a viscous medium contained in the cavity; and a damping member in the cavity coupled to the motor output shaft which interacts with the viscous medium to apply a retarding torque to the motor output shaft which increases with the speed of the motor so that the motor lacks sufficient power to overspeed substantially yet at low speed can provide high torque through the power train to rotate the nozzle housing.

14. A sprinkler as defined in claim 13, wherein the damping member is comprised of a plurality of ribs which extend longitudinally and radially relative to the motor output shaft in the cavity.

15. A sprinkler as defined in claim 14, wherein:

the fluid inlet is connectable to a source of compressed air when it is desired to purge water from the sprinkler; and the shaft and the ribs are sized in relation to the viscosity of the medium to provide sufficient braking when the motor is being driven by compressed air to prevent damage due to overspeeding.

16. A sprinkler as defined in claim 13, wherein the damping member comprises a disc mounted on the shaft within the cavity.

17. A sprinkler as defined in claim 16, wherein:

the fluid inlet is connectable to a source of compressed air when it is desired to purge water from the sprinkler; and the disc is sized in relation to the viscosity of the medium to provide sufficient braking when the motor is being driven by compressed air to prevent damage due to overspeeding.

18. A sprinkler as defined in claim 13, wherein:

the fluid inlet is connectable to a source of compressed air when it is desired to purge water from the sprinkler; and the damping member is sized and configured in relation to the viscosity of the medium to provide sufficient braking when the motor is being driven by compressed air to prevent damage due to overspeeding.

19. A sprinkler as defined in claim 1, wherein:

the fluid powered motor is comprised of:

a turbine having a rotor coupled to the motor output shaft, a flow directing stator including a plurality of inlet ports which direct a portion of the incoming fluid onto the rotor, a passage for directing the remainder of the water to the nozzle head, a pressure control mechanism for establishing a desired pressure drop across the inlet ports to drive the rotor, and an outlet for directing fluid from the rotor to the nozzle head;

the drive train includes a speed reduction mechanism driven by the motor output shaft which produces a desired rotational speed for the nozzle head; and the size and number of the inlet ports, and the established pressure drop are optimized in relation to the braking provided by the damping mechanism to provide a desired low speed torque at the nozzle head for reliable operation.

20. A gear driven sprinkler as defined in claim 19, wherein:

the viscous damping mechanism comprises:

a housing including a cavity which surrounds a portion of the drive train;

a viscous medium contained in the cavity; and the drive train includes a damping member located in the cavity which interacts with the viscous medium to generate a retarding torque that increases with the speed of the motor output shaft.

21. A sprinkler as defined in claim 20, wherein the damping member is located on the motor output shaft.

22. A sprinkler as defined in claim 20, wherein:

the motor output shaft extends through the cavity; and the damping member comprises an enlarged portion which extends longitudinally and radially relative to the motor output shaft in the cavity.

23. A sprinkler as defined in claim 22, wherein:

the fluid inlet is connectable to a source of compressed air when it is desired to purge water from the sprinkler; and the enlarged portion is sized in relation to the viscosity of the medium to provide sufficient braking when the motor is being driven by compressed air to prevent damage due to overspeeding.

24. A sprinkler as defined in claim 22, wherein the clearance between the enlarged portion and the inner wall of the cavity is in the range of about 0.005 to about 0.015 inch.

25. A sprinkler as defined in claim 20, wherein the viscosity of the viscous medium is between about SAE 10 and about SAE 70.

26. A sprinkler as defined in claim 20, wherein the viscous medium has a viscosity of about 500 centistokes.

27. A sprinkler as defined in claim 20, wherein the viscous medium is a silicone fluid.

28. A sprinkler as defined in claim 20, wherein:

the motor output shaft extends through the cavity; and the damping member comprises a disc mounted on the motor output shaft within the cavity.

29. A sprinkler as defined in claim 28, wherein:

the fluid inlet is connectable to a source of compressed air when it is desired to purge water from the sprinkler; and the disc is sized in relation to the viscosity of the medium to provide sufficient braking when the turbine is being driven by compressed air to prevent damage due to overspeeding.

30. A sprinkler as defined in claim 20, wherein the housing encloses a gear box in the drive train.

31. A sprinkler as defined in claim 20, wherein:

the fluid inlet is connectable to a source of compressed air when it is desired to purge water from the sprinkler; and the damping member is sized in relation to the viscosity of the medium to provide sufficient braking when the turbine is being driven by compressed air to prevent damage due to overspeeding.

32. A sprinkler as defined in claim 19, wherein:

the fluid inlet is connectable to a source of compressed air when it is desired to purge water from the sprinkler; and the damping mechanism is sized and configured to provide sufficient braking when the turbine is being driven by compressed air to prevent damage due to overspeeding.

33. A sprinkler as defined in claim 19, wherein the viscous damping mechanism comprises:

a bearing structure which supports the motor output shaft;

a cavity within the bearing structure which surrounds the motor output shaft;

liquid-tight seals at opposite ends of the cavity through which the motor output shaft passes and which provide support therefor;

a viscous medium contained in the hollow cavity; and a damping member on the motor output shaft located within the cavity which interacts with the viscous medium to apply a retarding torque to the motor output shaft which increases with the speed of the motor output shaft.

34. A sprinkler as defined in claim 33, wherein the damping member is comprised of an enlarged portion which extends longitudinally and radially relative to the motor output shaft on a part of the motor output shaft located in the cavity.

35. A sprinkler as defined in claim 34, wherein:

the fluid inlet is connectable to a source of compressed air when it is desired to purge water from the sprinkler;

the damping member is comprised of a plurality of ribs which extend longitudinally in the cavity; and the shaft and the ribs are sized in relation to the viscosity of the medium to provide sufficient braking when the turbine is being driven by compressed air to prevent damage due to overspeeding.

36. A sprinkler as defined in claim 33, wherein the damping member comprises a disc mounted on the motor output shaft within the cavity.

37. A sprinkler as defined in claim 36, wherein:

the fluid inlet is connectable to a source of compressed air when it is desired to purge water from the sprinkler; and the disc is sized in relation to the viscosity of the medium to provide sufficient braking when the turbine is being driven by compressed air to prevent damage due to overspeeding.

38. A method of operating a gear driven sprinkler including a fluid inlet, a rotatable nozzle head having a water discharge nozzle, a fluid powered motor having an output shaft, a speed reducing drive train rotationally coupled to the output shaft which provides power for rotating the nozzle head, and a dynamic viscous damping mechanism which cooperates with the drive train to apply a braking force, the method comprising the steps of:

connecting the fluid inlet of the sprinkler to a source of water;

driving the motor by directing a portion of the water from the fluid inlet thereto; and applying a braking force from the viscous damping mechanism which increases non-linearly with increases in the speed of the motor, the amount of water directed to the fluid motor, and the construction and configuration of the motor being optimized in relation to the braking force applied by the damping mechanism such that a sufficient low speed torque is provided by the drive train to the nozzle head for reliable and desired rotational speed for the sprinkler nozzle operation, wherein the step of driving the fluid motor includes the steps of:

directing the portion of the water to a turbine rotor through a plurality of inlet ports a flow directing stator;

maintaining a desired pressure drop across the inlet ports, directing water used to drive the rotor to the nozzle head, the size and number of the inlet ports and the desired pressure drop in relation to the braking provided by the damping mechanism being such as to provide the desired low speed torque at the nozzle head.

39. A method as defined in claim 38, wherein the braking force is applied by interacting a damping member coupled to the output shaft with a viscous medium in a cavity.

40. A method as defined in claim 38, wherein the damping member is comprised of an enlarged portion which extends longitudinally and radially relative to the shaft in the cavity.

41. A method as defined in claim 39, wherein the damping member is comprised of a disc which extends radially relative to the shaft in the cavity.

42. A method as defined in claim 39, wherein the viscosity of the viscous medium is between about SAE 10 and about SAE 70.

43. A method as defined in claim 39, wherein the viscous medium has a viscosity of about 500 centistokes.

44. A method as defined in claim 39, wherein the viscous medium is a silicone fluid.

45. A method as defined in claim 39, further including the step of connecting the water inlet to a source of compressed air when it is desired to purge water from the sprinkler, the damping mechanism being configured and dimensioned in relation to the medium viscosity of the medium to provide sufficient braking when the motor is being driven by compressed air to prevent damage due to overspeeding.

46. A method as defined in claim 38, wherein the braking force is applied by interacting a damping member coupled to the output shaft with a viscous medium in a cavity.

47. A method as defined in claim 46, wherein the damping member is comprised of an enlarged portion which extends longitudinally and radially relative to the shaft in the cavity.

48. A method as defined in claim 46, wherein the damping member is comprised of a disc which extends radially relative to the shaft in the cavity.

49. A method as defined in claim 46, wherein the viscosity of the viscous medium is between about SAE 10 and about SAE 70.

50. A method as defined in claim 46, wherein the viscous medium has a viscosity of about 500 centistokes.

51. A method as defined in claim 46, wherein the viscous medium is a silicone fluid.

52. A method as defined in claim 46, further including the step of connecting the water inlet to a source of compressed air when it is desired to purge water from the sprinkler, the damping mechanism being configured and dimensioned in relation to the viscosity of the medium to provide sufficient braking when the motor is being driven by compressed air to prevent damage due to overspeeding.

53. A method as defined in claim 47, wherein the enlarged portion is comprised of a plurality of ribs which extend longitudinally and radially relative to the motor output shaft in the cavity.

54. A sprinkler as defined in claim 39, wherein the enlarged portion is comprised of a plurality of ribs which extend longitudinally and radially relative to the motor output shaft in the cavity.

55. A sprinkler as defined in claim 13, wherein the damping member is comprised of an enlarged portion which extends longitudinally and radially relative to the motor output shaft on a part of the motor output shaft located in the cavity.

56. A sprinkler as defined in claim 55, wherein:

the fluid inlet is connectable to a source of compressed air when it is desired to purge water from the sprinkler; and the enlarged portion is sized in relation to the viscosity of the medium to provide sufficient braking when the motor is being driven by compressed air to prevent damage due to overspeeding.

57. A sprinkler as defined in claim 22, wherein the enlarged portion is comprised of a plurality of ribs which extend longitudinally and radially relative to the motor output shaft in the cavity.

58. A sprinkler as defined in claim 57, wherein:

the fluid inlet is connectable to a source of compressed air when it is desired to purge water from the sprinkler; and the motor output shaft and the ribs are sized in relation to the viscosity of the medium to provide sufficient braking when the motor is being driven by compressed air to prevent damage due to overspeeding.

59. A sprinkler as defined in claim 57, wherein the clearance between the enlarged portion and the inner wall of the cavity is in the range of about 0.005 to about 0.015 inch.

60. A sprinkler as defined in claim 34, wherein the enlarged portion is comprised of a plurality of ribs which extend longitudinally and radially relative to the motor output shaft in the cavity.

61. A sprinkler as defined in claim 34, wherein the clearance between the enlarged portion and the inner wall of the cavity is in the range of about 0.005 to about 0.015 inch.

62. A sprinkler as defined in claim 33, wherein the viscosity of the viscous medium is between about SAE 10 and about SAE 70.

63. A sprinkler as defined in claim 33, wherein the viscous medium has a viscosity of about 500 centistokes.

64. A sprinkler as defined in claim 33, wherein the viscous medium is a silicone fluid.

65. A sprinkler as defined in claim 33, wherein:

the fluid inlet is connectable to a source of compressed air when it is desired to purge water from the sprinkler; and the motor output shaft and the enlarged portion are sized in relation to the viscosity of the medium to provide sufficient braking when the motor is being driven by compressed air to prevent damage due to overspeeding.

66. A sprinkler as defined in claim 13, wherein the viscosity of the viscous medium is between about SAE 10 and about SAE 70.

67. A sprinkler as defined in claim 13, wherein the viscous medium has a viscosity of about 500 centistokes.

68. A sprinkler as defined in claim 13, wherein the viscous medium is a silicone fluid.

69. A sprinkler as defined in claim 1, wherein the damping member is comprised of a plurality of ribs which extend longitudinally and radially relative to the motor output shaft in the cavity.

* * * * *